US006230889B1

(12) United States Patent
Chen

(10) Patent No.: US 6,230,889 B1
(45) Date of Patent: May 15, 2001

(54) PERFUME BOTTLE CONTAINER

(76) Inventor: Sin-Hsiung Chen, P.O. Box 90, Tainan City (TW)

( * ) Notice: Subject to any disclaimer, the term of this patent is extended or adjusted under 35 U.S.C. 154(b) by 0 days.

(21) Appl. No.: 09/594,568

(22) Filed: Jun. 15, 2000

(51) Int. Cl.[7] ..... B65D 85/20
(52) U.S. Cl. ..... 206/446; 206/1.5; 401/118
(58) Field of Search ..... 206/38, 581, 446, 206/443, 1.5, 823, 758, 763, 774, 229; 222/321.7, 321.9, 325; 401/195, 126, 127, 128, 118, 41–43; 132/286

(56) References Cited

U.S. PATENT DOCUMENTS 5,419,879 * 5/1995 Vlahakis et al. ..... 422/305
5,507,401 * 4/1996 Huang ..... 215/12.1
5,513,754 * 5/1996 Chang ..... 206/581
5,702,035 * 12/1997 Tsao ..... 222/187
6,016,916 * 1/2000 Ortner ..... 206/581

* cited by examiner

*Primary Examiner*—Shian Luong

(57) ABSTRACT

A perfume bottle container includes a bottom base, a position base and a cap combined together. The position base is fitted on a chamber of the bottom base, having a spray hole and plural spring plates, closed on by the cap slidable up and down so as to let the spray hole expose when a perfume bottle placed in the chamber of the bottom base is to be used. The cap has two projecting strips to fit and slide up and down two slide grooves of the position base, and plural insert holes for projecting studs on plural spring plates of the position plates to engage, and the insert holes engage the studs when the cap is moved down to an open position wherein the spray hole is exposed for the perfume sprayed by a nozzle of a perfume bottle. When the cap is moved up to a closed position, the cap hides the spray hole.

3 Claims, 5 Drawing Sheets

PERFUME BOTTLE CONTAINER

BACKGROUND OF THE INVENTION

This invention relates to a perfume bottle container, particularly to one having a bottom base and a position base fitting with each other, and a cap closing on the position base and slidable and positioned on the positioning base to an open or a closed position. A perfume bottle is placed in a chamber of the bottom base stabilized, convenient to carry for use. So the cap will never fall off or be lost. The perfume bottle container has a sophisticated appearance, with a perfume bottle changeable.

A common perfume bottle 1 shown in FIG. 1 has a nozzle 10 on an upper portion, and a cap 11 closing the upper portion. In using it, first take off the cap 11 and push the nozzle, then spray the perfume in the bottle out. But it is often found that the cap 11 is not easily closed tightly, prone to fall off, forming a kind of inconvenience. In addition, the cap 11 and the bottle 1 are separable from each other, so the cap 11 often falls down or may be lost when in using. Or if the bottle is not placed upright and inclines, the perfume may ooze out or the nozzle may be soiled to lose true smell of the perfume.

SUMMARY OF THE INVENTION

This invention has been devised to offer a perfume bottle container for containing a perfume bottle.

The feature of the invention is a bottom base provided with a chamber, two plate springs fixed on the bottom of the chamber, and one side of the bottom base having an opening. A position base is combined on the bottom base, having plural elastic plates fixed on the wall of the position base, and a stud fixed on each elastic plate, a spray hole provided in the wall of the position base. Two opposite walls of the position base have respectively a slide groove, and the position base has an opening facing the sidewall with the opening of the bottom base. A cap closes on the position base, having plural insert holes in an inner wall to face the studs of the position base. And the two sidewalls of the cap have plural projecting strips to engage and slide up and down along plural insert grooves of two sidewalls of the position base.

BRIEF DESCRIPTION OF DRAWINGS

This invention will be better understood by referring to the accompanying drawings, wherein.

DETAILED DESCRIPTION OF THE PREFERRED EMBODIMENTS

Figure 1:
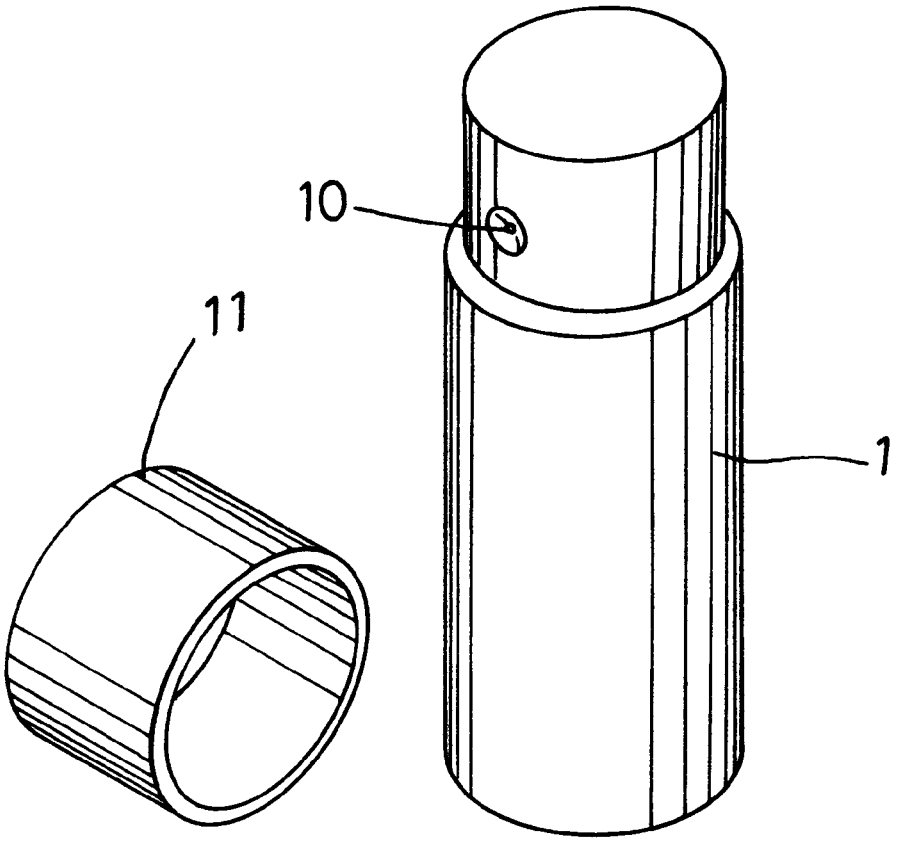
FIG. 1 (PRIOR ART)
FIG. 1 is a perspective view of a conventional perfume bottle.
Figure 2:
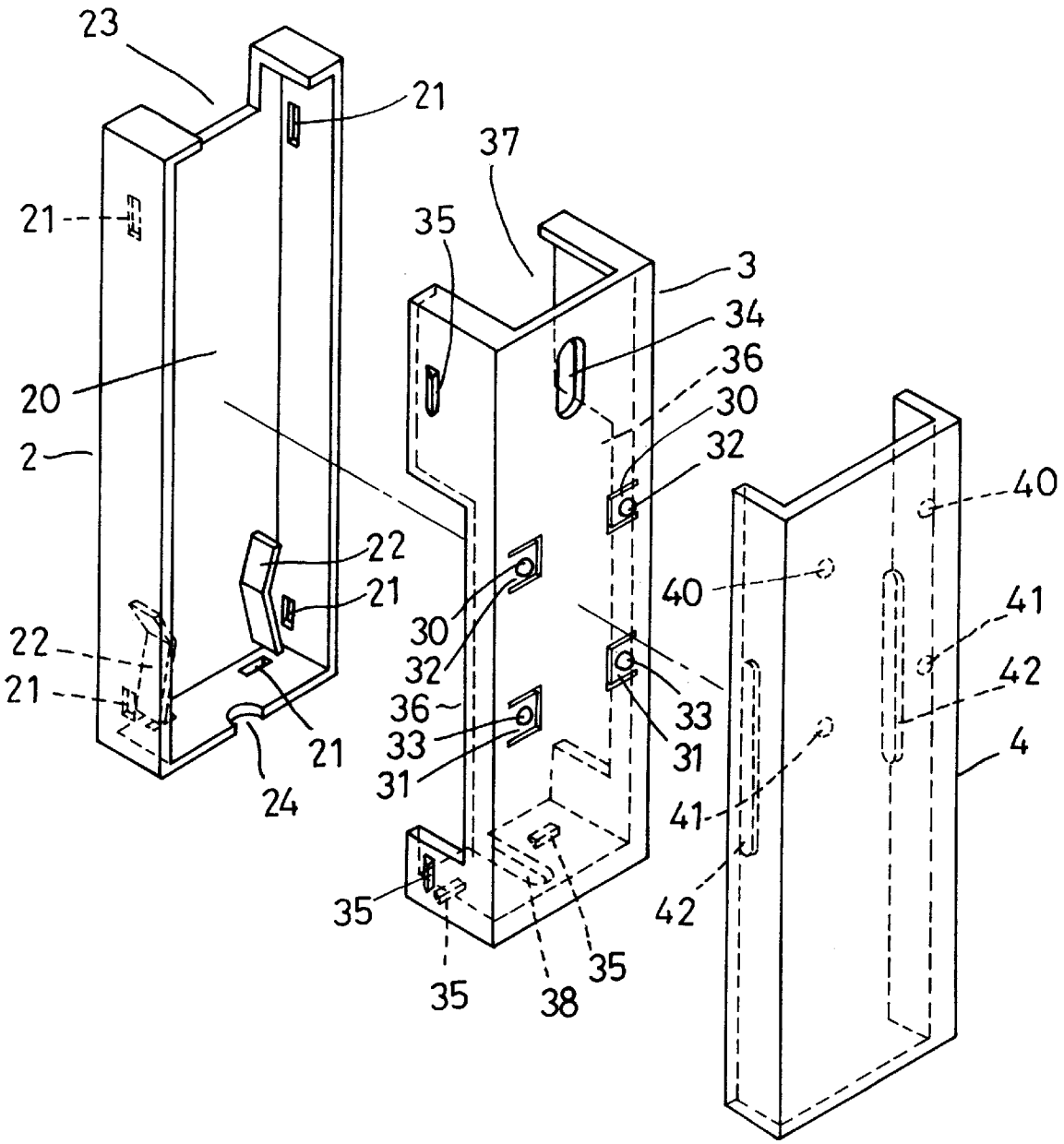
FIG. 2 is an exploded perspective view of a perfume bottle container in the present invention.

A preferred embodiment of a perfume bottle container in the present invention, as shown in FIG. 2, includes a bottom base 2, a position base 3 and a cap 4 as components combined together.

The bottom base 2 has a chamber 20, plural insert grooves 21 formed in two opposite inner walls of the chamber 20, two plate springs 22 bent respectively fixed spaced apart on an inner bottom and having an elastic clamp force, an opening 23 formed in an upper end of a side wall between the two opposite walls, and a notch 24 formed in an outer middle edge of a bottom wall.

The position base 3 inserts in an upper side of the chamber 20 of the bottom base 2, having two elastic plates 30, 31 respectively on a right side of a vertical wall and on a left side spaced apart and aligned vertically and laterally. Each elastic plate 30, 31 has a projecting stud 32, 33, and a spray hole 34 formed in a upper center portion of the center vertical wall, plural insert members 35 formed projecting on an outer wall surface, a slide groove 36 formed respectively in two opposite vertical side walls, a square opening formed in an upper side, and an aperture 38 formed in a bottom wall.

A cap is located on the position base, closing the bottom base 2, two holes 40, 41 respectively bored spaced apart on a right side and a left side of a center vertical wall aligned vertically and laterally. The two upper holes 40 are deep, and the other two lower holes 41 are shallow, and a projecting strip 42 formed on an inner surface of two opposite sidewalls.

Figure 3:
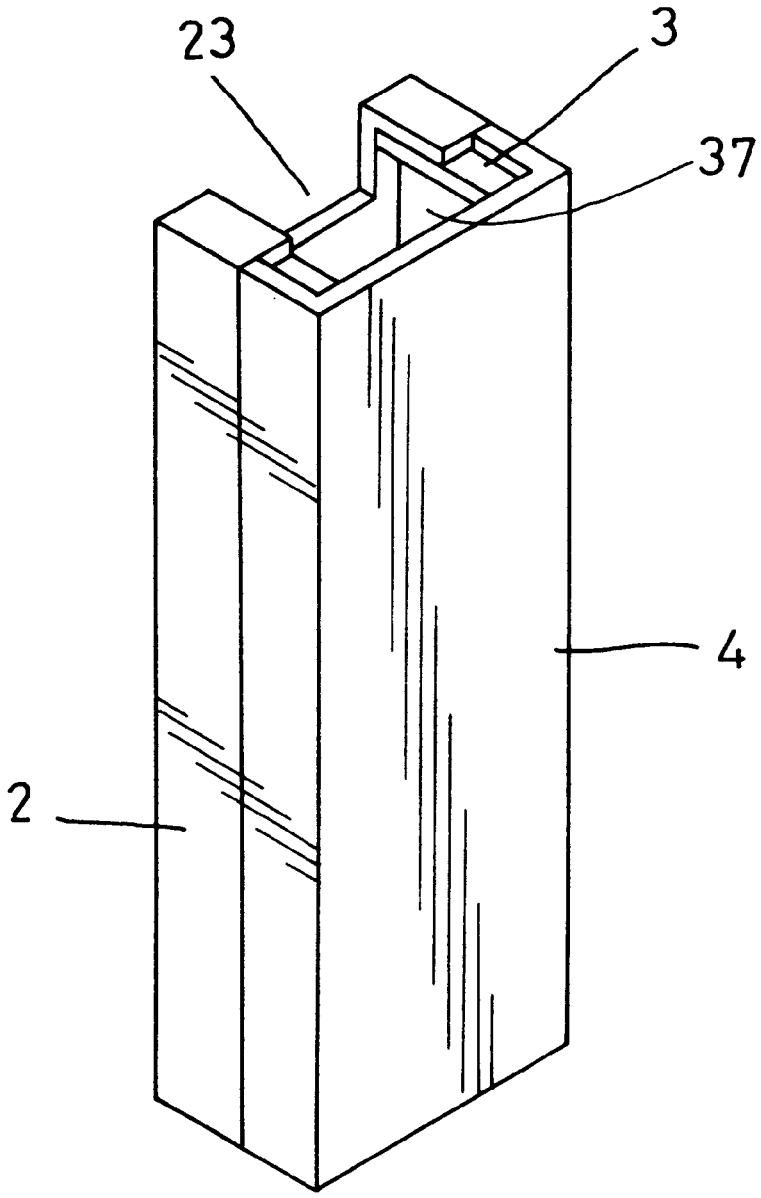
FIG. 3 is a perspective view of the perfume bottle container in the present invention.
Figure 4:
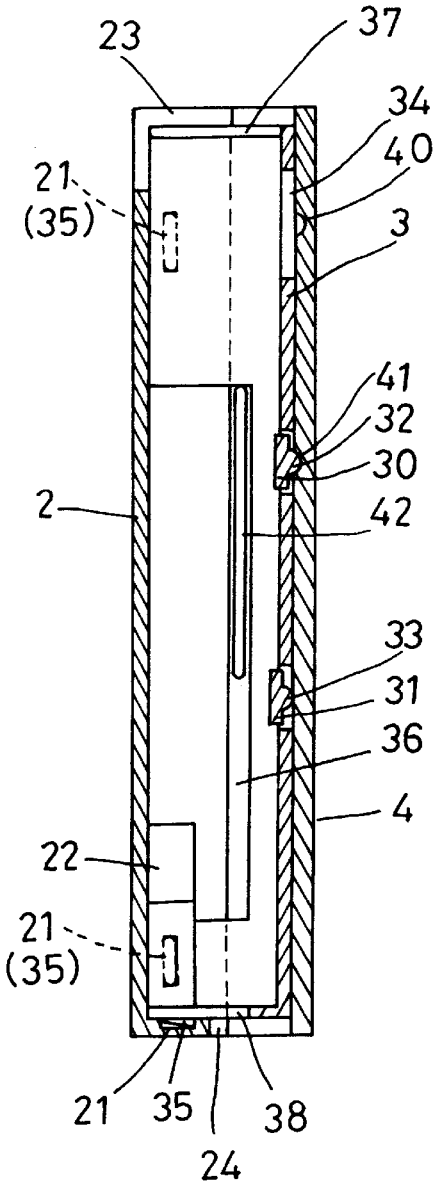
FIG. 4 is a cross-sectional view of the perfume bottle container in the present invention.

In assembling, referring to FIGS. 2, 3 and 4, firstly, the position base 3 is fitted in the chamber of the bottom base 2, with the insert members 35 fitting in related insert grooves 21 of the chamber 20, securing the position base 3 with the bottom base 2. Then the opening 37 of the position base 3 is aligned to the opening 23 of the bottom base 2, and the aperture 38 aligned to the notch 24. Then the cap 4 is closed on the position base 3 and combined with the bottom base 2 at the same time, with the projecting strips 42 of the cap 4 fitting slidably in the two slide groove 36, with the projecting studs 32 on the elastic plates 30 engaging the insert holes 41 of the cap 4. Thus the perfume bottle container is finished in assembly, light and convenient to be carried in a pocket or a handbag.

Figure 5:
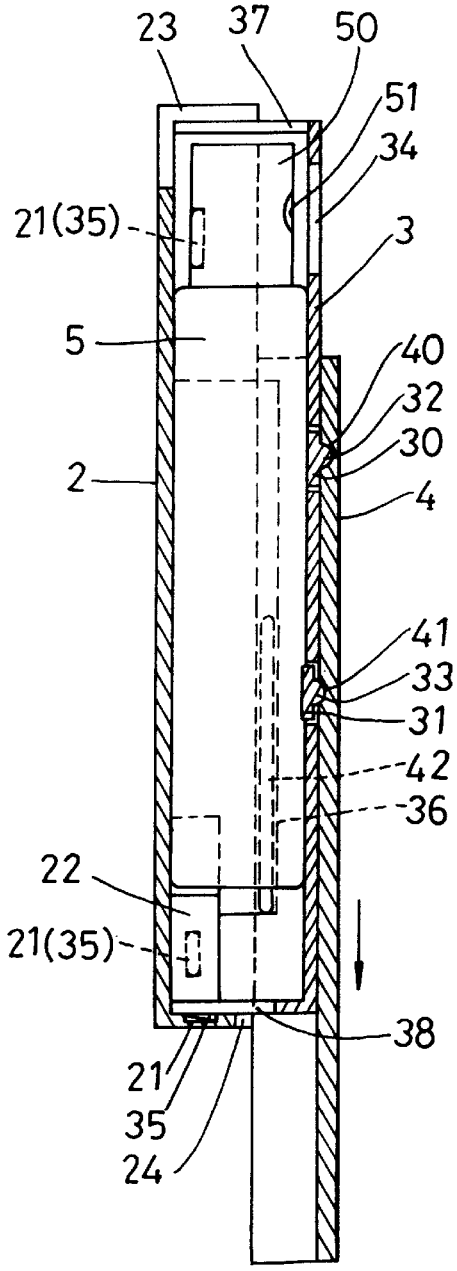
FIG. 5 is a cross-sectional view of a perfume bottle being to be placed in the perfume bottle container in the present invention.
Figure 6:
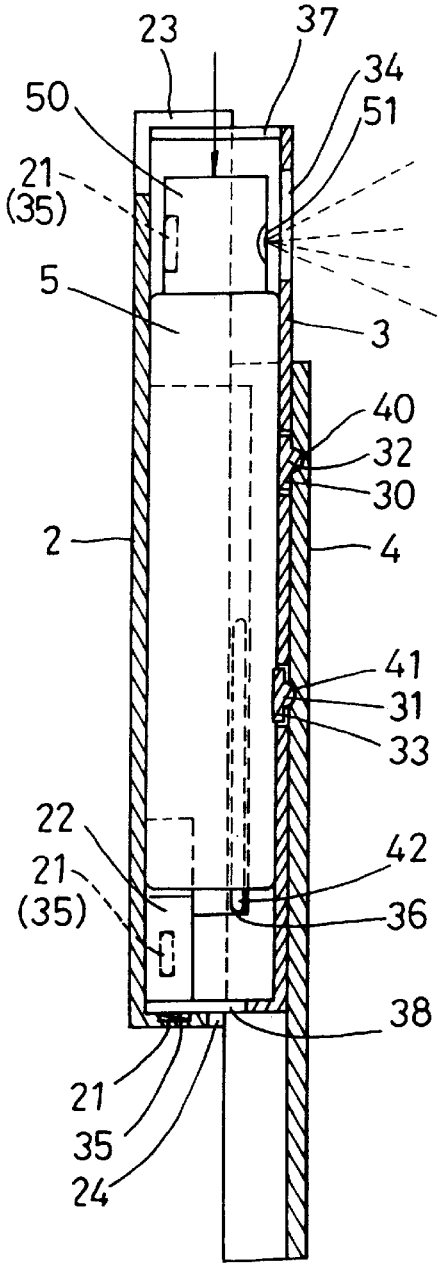
FIG. 6 is a cross-sectional view of a perfume bottle placed in the perfume bottle container being used to spray out perfume in the present invention; and, FIG. 7 is a cross-sectional view of a perfume bottle being taken out of the perfume bottle container in the present invention.

In using, as shown in FIGS. 5, and 6, a perfume bottle 5 is placed through the openings 23 and 37 of the bottom base 2 and the position base 3 in the chamber 20, letting the bottle 5 tightly clamped by the two plate springs 22 on the inner bottom of the chamber 20. Then the nozzle head 50 of the bottle 5 may just face the opening 23 of the bottom base 2, and the nozzle 51 just faces the spray hole 34 of the position base 3. Thus the cap 4 is pushed to slide down, with the projecting strips 42 sliding along the slide grooves 36, and with the projecting studs 32, 33 on the elastic plate 30, 31 elastically pressed down to let the cap 4 slide smoothly. When the lower ends of the two projecting strips 36 are stopped by the lower end surfaces of the slide grooves 36, and the projecting studs 32, 33 no longer pressed by the cap 4 and engaging the insert holes 40, 41, the cap is positioned immovable. Now the spray hole 34 is no more hidden by the cap 4, and a user can press down the nozzle head 50 of the bottle 50, as shown in FIG. 5, forcing the perfume in the bottle 5 sprayed out of the nozzle and through the spray hole 34 for use. After using, the cap is pushed up, with the projecting strips 42 sliding along the slide grooves 36 until the upper ends of strips 42 is stopped by the upper end surfaces of the slide grooves 36. In moving upward of the cap 4, its inner surface again presses down the projecting studs 32, 33, with the elastic plates 30, 31 pressed down to let the cap move smooth upward. When the inert holes 41 reach the projection 32, the elastic plates 30 recover its resilience to push the projecting stud engage the insert holes 41, securing the cap 4 in the closed position.

Figure 7:
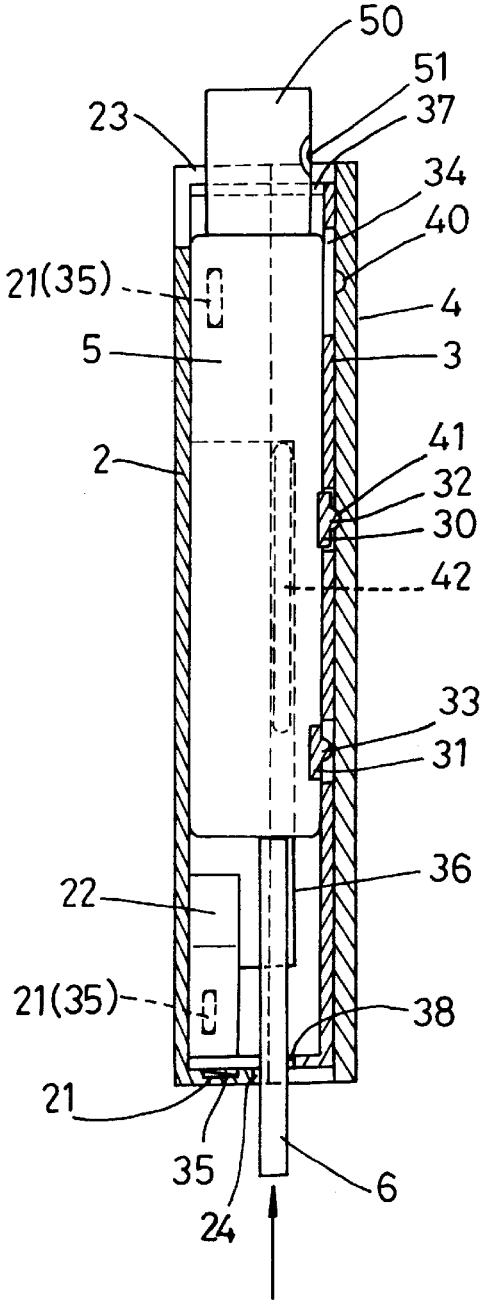

Moreover, when the perfume bottle 5 is to be changed to another one owing to using up or altering smell of the perfume, as shown in FIG. 7, extend a slender strip or rod 6 through the notch 24 and the aperture 38 of the bottom base 2 and the position base 3 and push up with a little force the old perfume bottle and let it separate from the clamping of the two plate springs 22 and take it out of the openings 23 and 37.

While the preferred embodiment of the invention has been described above, it will be recognized and understood that various modifications may be made therein and the appended claims are intended to cover all such modifications that may fall within the spirit and scope of the invention.

What is claimed is:

1. A perfume bottle container comprising:

a bottom base having a chamber having two opposite plate springs spaced apart on an inner bottom, and an opening formed in an upper end;

a position base placed in said chamber of said bottom base, having plural spring plates on its center vertical wall, a projecting stud respectively fixed on each said spring plate, a spray hole formed in said center vertical wall, a slide groove respectively formed in two opposite side walls, and an opening facing said opening of said bottom base;

a cap closing on said position base and the bottom base, having plural insert holes corresponding to said projecting studs of said position base, and a projecting vertical strip respectively formed on two side walls;

said projecting strips engaging and sliding along said two slide grooves of said position base from an upper position to a lower position, permitting said cap slide to an open position or a closed position, said insert holes of said cap engaging said projecting studs of said position base to keep said cap stabilized on said position base after sliding up to said open position or said closed position, thus said cap never falling off said position base or lost, a perfume bottle possible to be placed in said chamber of said bottom base stably and carried for use, or replaced with a new or another one.

2. The perfume bottle container as claimed in claim 1, wherein said bottom base has plural insert grooves formed in inner walls of said chamber, and said position base has plural insert members formed on an outer surfaces of two side walls, said insert grooves engaging said insert members to securely combine said bottom base with said position base.

3. The perfume bottle container as claimed in claim 1, wherein said bottom base has a notch in a bottom wall, and said position base has an aperture in a bottom wall to face said notch of said bottom base for a tool to extend through into said chamber to push up a perfume bottle placed therein out of said opening of said bottom base to be replaced with a new or another one.

* * * * *